US011149725B2

(12) United States Patent
Keijers et al.

(10) Patent No.: US 11,149,725 B2
(45) Date of Patent: Oct. 19, 2021

(54) HYDRAULIC PUMP SYSTEM FOR HANDLING A SLURRY MEDIUM

(71) Applicant: Weir Minerals Netherlands B.V., Venlo (NL)

(72) Inventors: Ronald Godefridus Anna Keijers, Venlo (NL); Arnoldus Gertrudis Hendrikus Wilmsen, Venlo (NL)

(73) Assignee: Weir Minerals Netherlands B.V., Venlo (NL)

( * ) Notice: Subject to any disclaimer, the term of this patent is extended or adjusted under 35 U.S.C. 154(b) by 95 days.

(21) Appl. No.: 15/001,941

(22) Filed: Jan. 20, 2016

(65) Prior Publication Data

US 2017/0204840 A1 Jul. 20, 2017

(51) Int. Cl.
*F04B 49/22* (2006.01)
*F04B 23/06* (2006.01)
(Continued)

(52) U.S. Cl.
CPC ..... *F04B 49/22* (2013.01); *F04B 15/02* (2013.01); *F04B 23/06* (2013.01); *F04B 49/106* (2013.01)

(58) Field of Classification Search
CPC ..... F04B 15/02; F04B 23/06; F04B 49/106; F04B 49/22; F04B 7/0053; F04B 7/0049;
(Continued)

(56) References Cited

U.S. PATENT DOCUMENTS 3,162,133 A * 12/1964 Smith ..... F04B 15/02 417/393
5,222,872 A * 6/1993 Marian ..... F04B 9/1056 417/317
(Continued)

FOREIGN PATENT DOCUMENTS

EP 2799712 A2 11/2014
JP H0633767 B2 * 5/1994 ..... F04B 7/0266
(Continued)

OTHER PUBLICATIONS

Author: Charilos Karambalis Title: Pulsation Free Hydraulically Driven Piston Pump Date Published (mm/dd-dd/yyyy): Jun. 17-20, 2013 Date Accessed (mm/dd/yyyy): Jan. 31, 2018 Link: http://www.paste2013.com/wp-content/uploads/2013/07/Charilos-Karambalis-Pulsation-Free-hydraulically-driven-piston-pump.pdf.*
(Continued)

*Primary Examiner* — Charles G Freay
*Assistant Examiner* — Chirag Jariwala
(74) *Attorney, Agent, or Firm* — Casimir Jones, S.C.; Brian F. Bradley

(57) ABSTRACT

This disclosure relates to a hydraulic pump system for handling a slurry medium comprising at least two reciprocating positive displacement pumps, both pumps being arranged for alternating intake of slurry medium via a suction inlet and discharge of slurry medium via a discharge outlet, and piston/cylinder discharge valves for alternating closing and opening each discharge outlet. In a first aspect,
(Continued)

a hydraulic pump system for handling a slurry medium, comprising at least two reciprocating positive displacement pumps, both pumps being arranged for alternating intake of slurry medium via a suction inlet and discharge of slurry medium via a discharge outlet, and piston/cylinder discharge valves for alternating closing and opening each discharge outlet, as well as control means for controlling the alternate closing and opening of both piston/cylinder discharge valves, such that during operation no volume difference occurs in the discharge of slurry medium is disclosed. In another aspect the control means comprise a lever assembly interconnecting the pistons of both piston/cylinder driven valves.

8 Claims, 5 Drawing Sheets

(51) Int. Cl.
*F04B 15/02* (2006.01)
*F04B 49/10* (2006.01)

(58) Field of Classification Search
CPC .. F04B 7/0266; F04B 7/02; F04B 7/00; F04B 17/03; F04B 19/20; F04B 19/22; F04B 23/00; F04B 23/04; F04B 49/005; F04B 9/10; F04B 9/109
USPC ..... 417/900; 251/318, 324; 137/596.18, 137/601.13, 601.01
See application file for complete search history.

(56) References Cited

U.S. PATENT DOCUMENTS

| | | | | |
|---|---|---|---|---|
| 5,336,052 | A * | 8/1994 | Zollner | F04B 15/02 417/20 |
| 5,634,773 | A * | 6/1997 | Tanino | F04B 9/1178 417/46 |
| 2007/0196219 | A1 | 8/2007 | Hofling et al. | |
| 2013/0078114 | A1 | 3/2013 | Van Rijswick et al. | |

FOREIGN PATENT DOCUMENTS

| | | | |
|---|---|---|---|
| JP | 2001-207952 | A | 8/2001 |
| JP | 2010-101170 | A | 5/2010 |

OTHER PUBLICATIONS

Putzmeister AG, High-Density Solids Pumps—Design & Application, 1999.

* cited by examiner

HYDRAULIC PUMP SYSTEM FOR HANDLING A SLURRY MEDIUM

BACKGROUND ART

This disclosure relates to a hydraulic pump system for handling a slurry medium at least comprising at least two reciprocating positive displacement pumps, both pumps being arranged for alternating intake of slurry medium via a suction inlet and discharge of slurry medium via a discharge outlet, and piston/cylinder discharge valves for alternating closing and opening each discharge outlet.

In reciprocating positive displacement pumps, a displacement element, such as a piston or plunger, undergoes a reciprocating motion inside a cylinder housing enabling the positive displacement the slurry medium to be handled (displaced or pumped). In a particular embodiment of the reciprocating pump, the reciprocating motion of the displacement element is generated by a mechanism which transfers the rotating motion of the pump drive mechanism into a reciprocating motion of the displacement element. Particular embodiments of this mechanism may include crankshaft, excentric shaft, camshaft or cam disc mechanisms, for example as disclosed in FIG. 1 of WO2011/126367.

Such reciprocating positive displacement pumps are used for pumping slurry media against relatively high pressure, when compared to single stage centrifugal pumps, for example. Further characteristics of such positive displacement pumps include high efficiency and an accurate flow output, but a relatively low flow capacity when compared to centrifugal pumps. When the flow requirements of a typical application cannot be met with a single pump, multiple positive displacement pumps can be arranged in parallel in a manner so that their suction inlets and/or discharge outlets are connected and combined into a single suction and/or discharge line. This means that the sum flow of the individual pumps can meet the total flow requirements of the application. The combination of the individual displacement pumps and the interconnecting suction and discharge lines forms a pumping system.

In the aforementioned prior art publication WO2011/126367, a phase shift control system is disclosed for a pump system comprised of multiple reciprocating positive displacement pumps, wherein the speed of the individual pumps is controlled such that a desired phase shift between the pump cycles of the individual pumps is obtained and maintained. Each discharge outlet of the individual pumps is provided with a discharge valve, which is to be opened and closed at the right time during the individual pump cycles of the individual pumps. To create a nearly pulsation-free flow in the discharge outlet, apart from a proper phase shift control of the displacement pumps, the discharge valves also are closed and opened in a controlled manner, preferably such that the pressure across the discharge valve is zero.

To make sure that the pressure across the discharge valve is zero, a pre-compression stroke is performed prior to the opening of the respective discharge valve. Pressure fluctuations in the discharge flow of the displaced slurry medium results in variable consistency during further processing and hence adversely affects the product quality of the slurry medium.

Furthermore the displacement of the valve rods of the respective discharge valves, which are operated independently of each other, create a small change in the flow and therewith a fluctuation in the pressure in the outlet.

SUMMARY OF THE DISCLOSURE

In a first aspect, embodiments are disclosed of a hydraulic pump system for handling a slurry medium, comprising at least two reciprocating positive displacement pumps, both pumps being arranged for alternating intake of slurry medium via a suction inlet and discharge of slurry medium via a discharge outlet, and piston/cylinder discharge valves for alternating closing and opening each discharge outlet, as well as control means for controlling the alternate closing and opening of both piston/cylinder discharge valves, such that during operation no volume difference occurs in the discharge of slurry medium.

In another aspect of the hydraulic pump system said control means comprise a lever assembly interconnecting the pistons of both piston/cylinder driven valves.

In particular said lever assembly comprises a lever having two ends, each end being hingely connected with the piston of one of said piston/cylinder driven valves.

In another aspect said piston/cylinder discharge valves are hydraulic piston/cylinder driven discharge valves and wherein said control means comprise a hydraulic line interconnecting both cylinders of said hydraulic piston/cylinder driven discharge valves.

In one embodiment, the hydraulic line can interconnect both cylinders at the piston side thereof, whereas in another embodiment said hydraulic line interconnects both cylinders at the cylinder side thereof. This means that no volume difference will occur during the closing and opening strokes of both discharge valves as the displaced hydraulic volume during opening of a discharge valve is added via the interconnecting hydraulic line to other discharge valve during closing. Since no volume fluctuations in the discharge flow of the displaced slurry medium will occur, this results in a product (the displaced slurry medium) with the same consistency and hence product quality.

In one embodiment, each hydraulic piston/cylinder driven discharge valve can comprise a first sensor for sensing the position of the piston in the closed position of the discharge valve as well as a second sensor for sensing the position of the piston in the open position of the discharge valve. Thus the opposite extreme positions of the pistons of both discharge valves are electronically monitored, as the assistance of these proximity switches guarantee a synchronized movement of both pistons. In addition, no change in combined volume on the discharge side will occur.

Due to this synchronization the opening of one discharge valve will automatically result in the closing of the other discharge valve and hence no undesired fluctuation in the flow through the discharge outlet will occur.

In one embodiment, the system may further comprise an hydraulic refill means for adding hydraulic medium to a hydraulic piston/cylinder driven discharge valve based on signals generated by the first sensor of a discharge valve and the second sensor of the other discharge valve such that the combined hydraulic volume of both pistons chambers and the interconnecting hydraulic line is always so that the pistons will reach their extreme position during operation of the pump system. In such an arrangement, the opening of one discharge valve will automatically result in the closing of the other discharge valve and unwanted fluctuation in the discharge flow is avoided.

In one embodiment, the pump system can further comprise one or more hydraulic piston/cylinder driven suction valves for alternating closing and opening each suction inlet.

In one embodiment, the pump system can further comprise a pump housing having a central inlet interconnecting both suction inlets as well as a central outlet interconnecting both discharge outlets.

In one embodiment, said pump housing can comprise two pump chambers, each pump chamber being interconnected with one of said reciprocating positive displacement pumps, and each pump chamber being provided with a suction inlet and a discharge outlet. This provides a simple but effective construction of the pump system with limited dimensions is obtained, which is beneficial in case of installation and maintenance.

Other aspects, features, and advantages will become apparent from the following detailed description when taken in conjunction with the accompanying drawings, which are a part of this disclosure and which illustrate, by way of example, principles of inventions disclosed.

BRIEF DESCRIPTION OF THE DRAWINGS

The accompanying drawings facilitate an understanding of the various embodiments.

DETAILED DESCRIPTION

Figure 1:
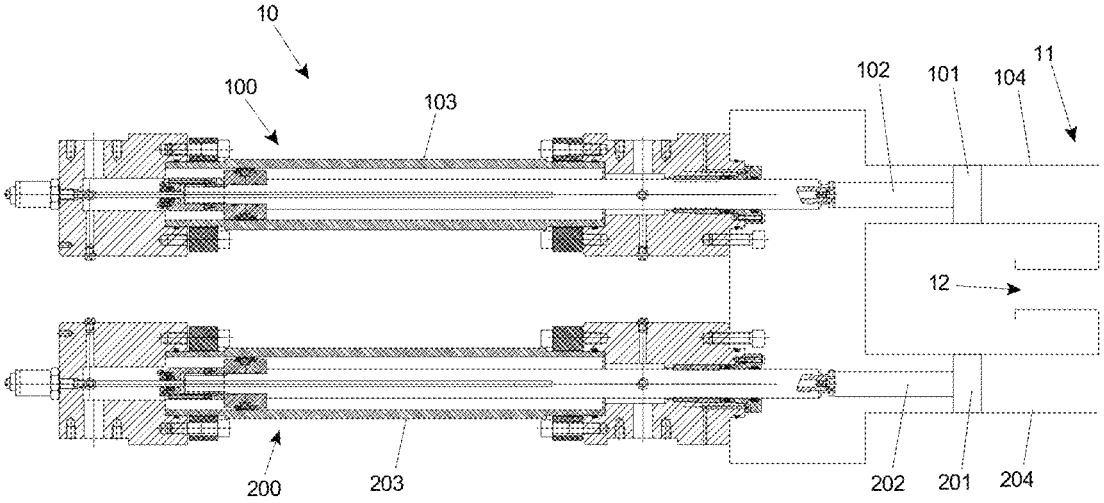
FIG. 1 is a first partial view of an embodiment of a pump system in accordance with the present disclosure.
Figure 2A:
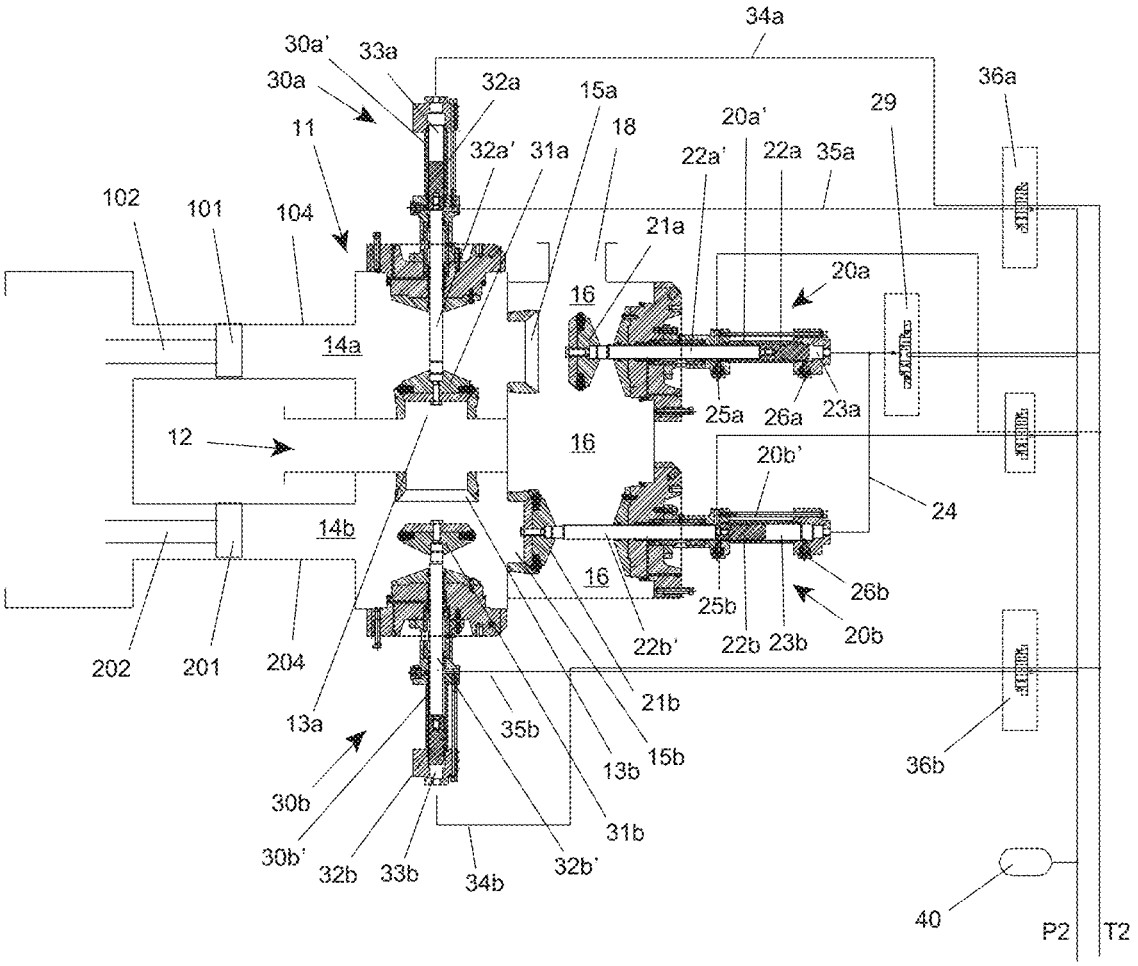
FIG. 2*a* a second partial view of an embodiment of a pump system in accordance with the present disclosure.

FIG. 1 and FIG. 2*a* combined disclose a non-limitative embodiment of an hydraulic pump system. The hydraulic pump system is denoted with reference numeral 10 and consists of at least two reciprocating positive displacement pumps 100 and 200 which are connected to a pump housing 11. Each of the reciprocating positive displacement pumps 100 and 200 consist of a pump structure in which a displacement element 101 (201), shaped as a piston, is movable accommodated in a cylinder housing 104 (204). The displacement element 101 (201) is connected via a piston rod 102 (202), which is displaced in a reciprocating manner using a pump drive mechanism 103 (203), not shown.

Such a reciprocating positive displacement pump is capable of pumping or handling a slurry medium against relatively high pressure when compared to other types of pumps, such as centrifugal pumps. In particular, a positive displacement pump (as denoted with reference numeral 100 in FIG. 1) can operate at a high pressure level and generate an accurate flow output of the slurry medium to be displaced, albeit with a relatively low flow capacity. For increasing the flow capacity of the slurry medium to be displaced, multiple reciprocating positive displacement pumps (in FIG. 1 two of such pumps 100, 200 are shown) are used in a parallel manner as depicted in FIG. 1 and their combined pump characteristic is used for obtaining the required and necessary increased discharge flow of the slurry medium.

The pump drive mechanism 103 (203) are driven in such a manner that the displacement elements 101 (201) are moving in a reciprocating manner, but also in an 'out-of-phase' manner. This means that one positive displacement pump performs its discharge stroke, whereas the other positive displacement pump performs its suction stroke. The alternating suction and discharge strokes of the two positive displacement pumps results in a combined discharge flow of the individual pumps, the sum of which can meet the total flow requirements of the industrial application in which the hydraulic pump system is to be implemented.

FIG. 2*a* discloses in more detail another part of the pump system 10 in particular the pump housing 11 to which both reciprocating positive displacement pumps 100 and 200 are connected.

The pump housing 11 is provided with a central suction inlet 12 and a central discharge outlet 18 for the intake and discharge of slurry medium to be pumped by the pump system 10. For each individual positive displacement pump 100 (200) the central suction inlet 12 is in fluid communication with suction inlet chambers 14*a* (14*b*) via suction inlets 13*a* (13*b*). Each individual suction inlet 13*a* (13*b*) can be opened and closed by so-called hydraulic piston/cylinder driven suction valves 30*a* (30*b*). Each suction valve 30*a* (30*b*) comprises a valve body 31*a* (31*b*) which cooperates with the seat of the individual suction inlet 13*a* (13*b*) when said suction valve 30*a* (30*b*) is in his closed position. Each valve body 31*a* (31*b*) is mounted to a piston rod 32*a*' (32*b*'), which rod 32*a*' (32*b*') is provided with a piston element 32*a* (32*b*) which is movable accommodated in a valve housing 30*a*' (30*b*'). The piston element 32*a* (32*b*) and the valve housing 30*a*' (30*b*') define a cylinder chamber 33*a* (33*b*) which is filled with a hydraulic medium.

The hydraulic medium can be introduced in an alternating manner on either side of the piston element 32*a* (32*b*) via hydraulic lines 34*a*-35*a* (34*b*-35*b*) and by means of a manifold valve 36*a* (36*b*) which connects to supply lines P2 and T2. Supply line P2 contains a reservoir 40 for hydraulic medium. Supply of hydraulic medium to either side of the piston element 32*a* (32*b*) causes the hydraulic valve 30*a* (30*b*) to open or close the respective suction inlet 13*a* (13*b*) by means of the valve body 31*a* (31*b*).

Each suction chamber 14*a* (14*b*) is in fluid communication with the cylinder chamber 104 (204) in which the displacement element 101 (201) is displaced in a reciprocating manner during operation.

Each individual suction chamber 14*a* (14*b*) is furthermore provided with a discharge outlet 15*a* (15*b*). Both discharge outlets 15*a* (15*b*) communicates in a combined discharge chamber 16 and further with the central discharge outlet 18.

Both individual discharge outlets 15*a* (15*b*) are arranged to be opened and closed by discharge valves 20*a* (20*b*). Each discharge valve 20*a* (20*b*) comprises a valve body 21*a* (21*b*) which cooperates with the seat of the individual discharge outlet 15*a* (15*b*) when said discharge valve 20*a* (20*b*) is in his closed position.

In FIG. 2*a*, the discharge valve 20*b* is depicted in its closed position where valve body 21*b* fits in the seat of the discharge outlet 15*b* thereby closing the suction chamber 14*b* from the combined discharge chamber 16. Likewise the discharge valve 20*a* is in its open position allowing fluid communication between the suction chamber 14*a* and the central discharge chamber 16 (and hence the central discharge outlet 18).

Also depicted in FIG. 2*a* in this operational situation the suction valve 30*a* is in its closed position having a valve body 31*a* which closes the seat of the suction inlet 13*a*. Similarly the other suction valve 30*b* is in its open condition allowing the suction inlet 13*b* to be in fluid communication with the central inlet 12 and the suction chamber 14*b*.

In this operational situation, the positive displacement pump 100 performs its discharge stroke wherein the discharge element 101 is displaced in the cylinder 104 discharging any slurry medium contained in the suction chamber 14 via the discharge outlet 15*a*, the central discharge chamber 16 towards the central discharge outlet 18, and hence out of the pump system. Likewise the positive displacement pump 200 performs its suction stroke wherein the displacement element 201 performs a movement which is contrary to the movement of the displacement element 101 of the positive displacement pump 100 during the discharge stroke. During the suction stroke of the displacement element 201 slurry medium is taken from the central suction inlet 12 through the suction inlet 13*b* into the suction chamber 14*b*.

In general the intake amount of slurry via the suction inlet is defined by the amount of slurry medium being displaced by the previous discharge stroke of said positive displacement pump.

After completion of the suction stroke of the positive displacement pump 200 and the simultaneous completion of the discharge stroke of the other positive displacement pump 100, the suction valve 30*b* is closed under simultaneous opening of the suction valve 30*a*. Likewise the discharge valve 20*a* is closed whereas the discharge valve 20*b* is opened.

The subsequent suction stroke of the positive displacement pump 100 causes slurry medium to be taken in the now discharged pump chamber 14*a* via the suction inlet 13*a* and the slurry medium contained in the other suction chamber 14*b* is now being discharged by the positive displacement pump 200 during its discharge stroke. Said discharged slurry medium is forced through the now open discharge outlet 15*b* into the combined discharge chamber 16 and towards the central discharge outlet 18.

As already described in the preamble of this patent application, an accurate control of the reciprocating pump cycles of the individual pumps is desired to create a nearly pulsating free flow in the central discharge outlet. However in the presently known prior art pump systems, pressure pulsations in the discharge flow still occur for several operational and hydraulic causes.

In the known pump systems, the discharge valves are operated independently. When looking to FIG. 2*a*, and in particularly to the closed discharge valve 20*b*, it is evident that the valve body 21*b* together with the part of the piston rod 22*b* extending in the discharge chamber 16 represents a certain volume, which is not occupied by slurry medium present in the discharge chamber 16. At the time of opening of the discharge valve 20*b*, this volume previously occupied by the extended piston rod and valve body becomes available to the overall slurry medium volume in the discharge chamber 16. This extra volume becoming available causes a volume drop and hence a temporary pressure drop occurs.

Likewise when closing a discharge valve by displacing the valve body and the piston rod into the seat of their respective discharge outlet, this additional volume is added to the discharge chamber 16, causing an additional slurry medium volume change to the slurry medium volume being displaced via the central discharge outlet 18 and hence a temporary pressure increase. The independent control of the discharge valves in the prior art pump systems creates undesired volume changes during opening and closing which adds to the small pressure fluctuations in the slurry medium being discharged via the central discharge outlet 18.

Figure 3:
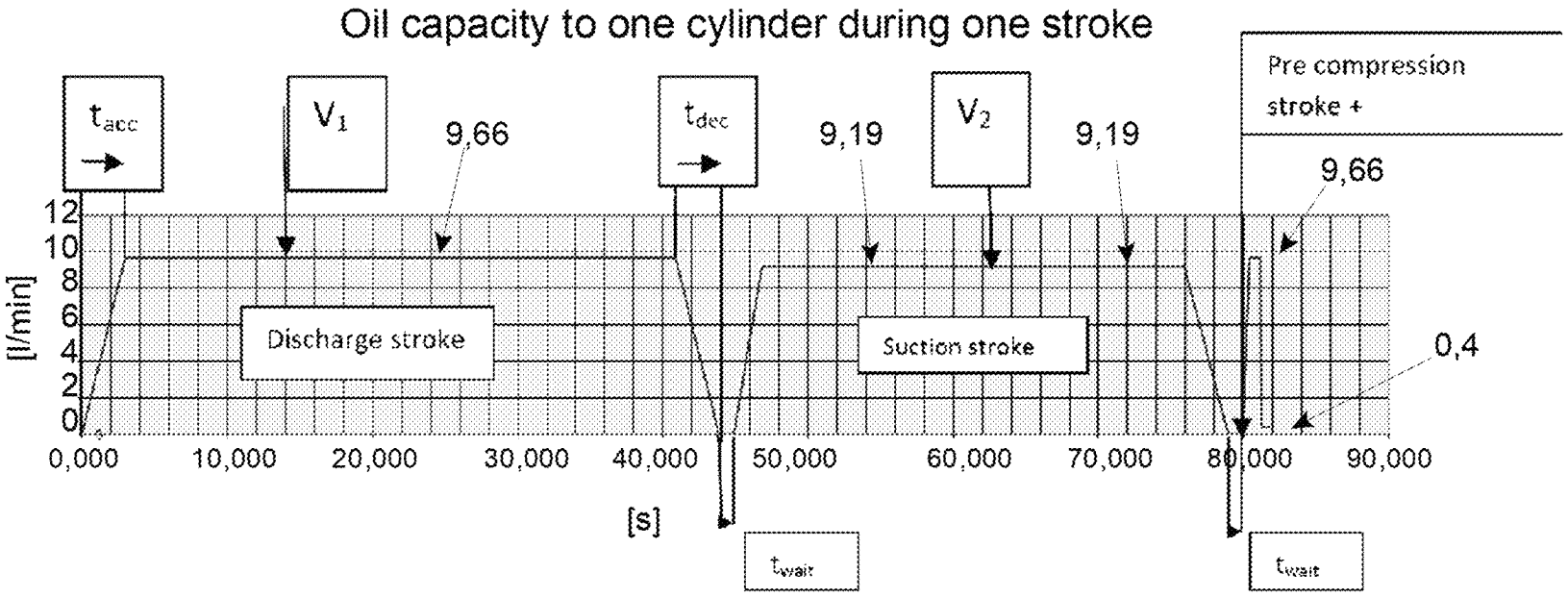
FIG. 3 a pump characteristic of an embodiment of a pump system in accordance with the present disclosure.

In addition to the above drawback, to make sure that the pressure across the discharge valve bodies 21*a* and 21*b* during the switching over between the suction and discharge strokes is as minimal as possible, each positive displacement pump performs a pre-compression stroke on the slurry medium to be discharged in their respective pumping chamber 14*a* (or 14*b*) prior to the opening of the respective valve body 21*a* (or 21*b*) of the discharge valves 20*a* (or 20*b*). Such pre-compression stroke is depicted in FIG. 3, which discloses to the pump characteristic and sequence control of one displacement element 101 (201) of each positive displacement pump. Each pump performs three stages in a sequential manner:

a. First the discharge stroke in which starting from t=0 the velocity is ramped up from the pre-compression velocity to the required discharge velocity $V_1$ at $t_{acc}$.

b. After completing the discharge stroke the pump switches to the suction stroke. The actual required velocity $V_2$ of the suction stroke is determined by controlling the time on which the discharge valve of the pre-compressed pump is opened.

c. Finally, the pre-compression stroke, in which the pressure in the cylinder of the pump is pre-compressed to the same pressure as the pressure in the second pump, which performs at that moment the discharge stroke.

However, due to the mass and inertia of the heavy components of such pumps, pre-compression of the slurry medium requires extra drive time and therefore the speed of the respective cylinder is increased during its suction stroke. Unfortunately pressure fluctuations still occur because, in the known systems, the pre-compression of the cylinder is not 100% completed at the moment that the ramp up—ramp down step starts (the switching over between the suction and discharge stroke of positive displacement pumps 100 and 200), which can occur if the filling is lower than expected.

The above drawbacks together with mass and inertia constraints of the pump components still create small pressure fluctuations over the valve body 21*b* (or 21*b*) during the switching over from the discharge towards the suction stroke of each positive displacement pump 100 (200). Such small pressure fluctuations are undesirable when the slurry medium to be pumped by said pump system has a biomass nature.

Pump systems as described above when used in biomass applications, for example where the slurry medium to be pumped consists of wood pulp, requires no pressure pulsations in the central discharge outlet. No pressure fluctuations in the central discharge outlet 18 leads to a better biomass product produced in the biomass installation connected to the central discharge outlet 18. In practice, it is evidenced that a small pressure fluctuation in the discharge flow leads to a biomass product having a different consistency and therefore an inferior quality.

The pump system 10 as disclosed in FIGS. 1 and 2*a* is capable of generating a discharge flow of the displaced slurry medium through the central discharge outlet 18 with no pressure fluctuations resulting in a constant consistency of the biomass slurry medium. This leads to an improved and constant product quality of the biomass slurry medium for further processing in a biomass installation.

According to the present disclosure, the pump system is now capable in providing a pulsation free flow in the discharge outlet 18. This is accomplished by means of control means, which control the alternate closing and opening of both piston/cylinder discharge valves 20*a*-20*b*, such that during operation no volume difference occurs in the discharge 18 of slurry medium. In FIG. 2*a* said control means comprise a hydraulic line 24 which interconnects both cylinder chambers 23*a* and 23*b* of the discharge valves 20*a* and 20*b*.

As outlined, each discharge valve 20*a* comprises a valve body 21*a* (21*b*) which fits in the seat of the discharge outlet 15*a* (15*b*). The valve body is mounted on a piston rod 22*a*' (22*b*') which ends with a piston element 22*a* (22*b*), which is movable accommodated in a valve housing 20*a*' (20*b*'). The piston element 22*a* (22*b*) and the valve housing 20*a*' (20*b*') define a cylinder chamber 23*a* (23*b*) which is filled with a hydraulic medium. Due to the hydraulic interconnection between both cylinder chambers 23*a* and 23*b* via the interconnecting hydraulic line 24, no volume difference between both discharge valves will occur during the simultaneous switching of both discharge valves 20*a* and 20*b* from their open and closed position.

This means that once the valve 21*b* of the discharge valve 20*b* is displaced from its closed position towards its open position (as shown in FIG. 2*a*), the hydraulic medium contained in the cylinder chamber 23*b* is displaced by means of the piston element 22*b* via the interconnecting hydraulic line 24 towards the cylinder chamber 23*a* causing the piston element 22*a*, the piston rod 22*a*' and the valve body 21*a* to be displaced towards the closed position until the valve body 21*a* rests in the seat of the discharge outlet 15*a*.

No volume differences will occur inside the discharge chamber 16 as the slurry medium volume increases, due to the withdrawal of the (volume of) piston rod 22*b*' into valve housing 20*b*' (and partly of valve body 21*b*), which will be simultaneously compensated by the slurry medium volume decrease, due to the expansion of the (volume of) piston rod 22*a*' out of valve housing 20*a* (and partly of valve body 21*a*).

As a result, undesirable pressure differences across the discharge outlet will be avoided, and a fully pressure pulsation free discharge flow in the central discharge outlet 18 is obtained.

Furthermore, the pre-compression stroke is fully completed at the moment the ramp up—ramp down action is initiated and the sum of the hydraulic medium flows of both cylinders is always 100%.

Figure 2B:
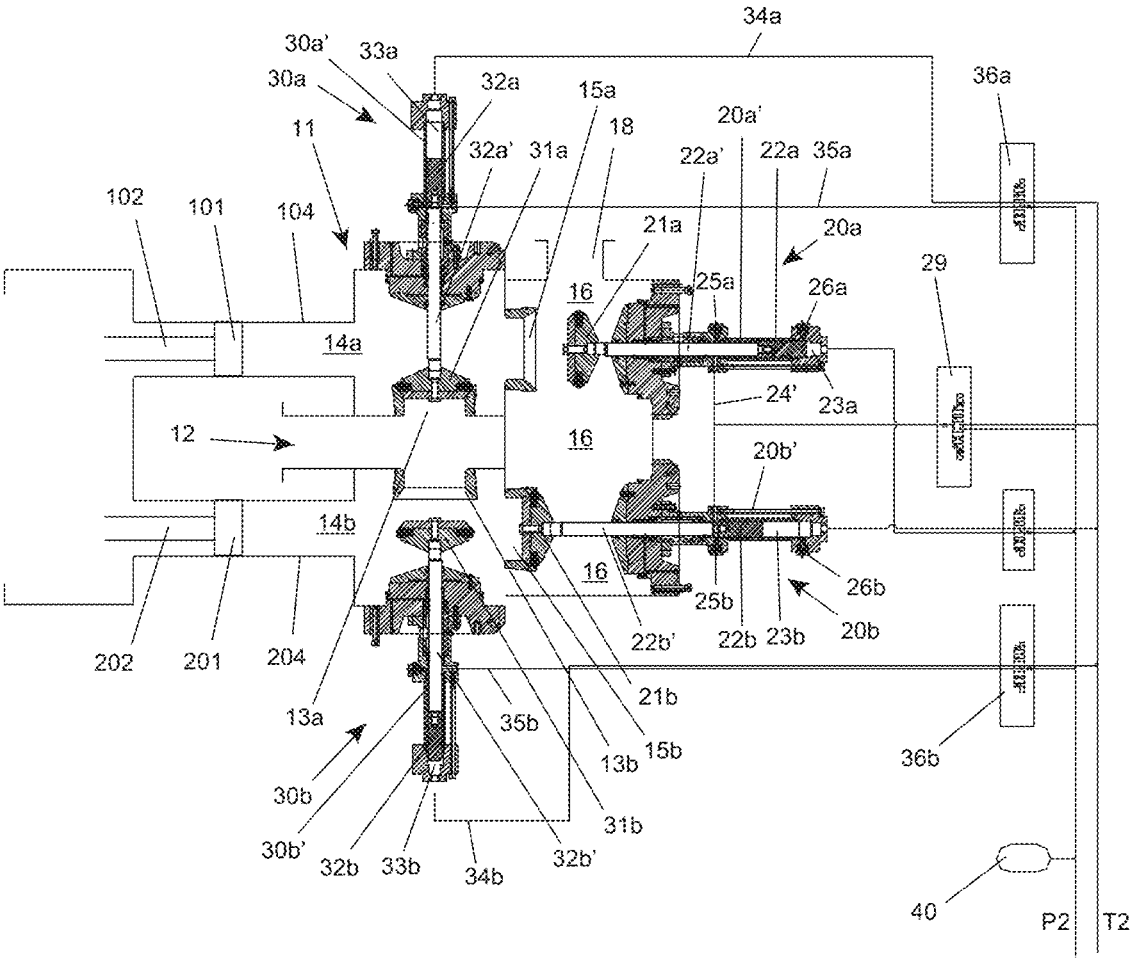
FIG. 2*b* a partial view of another embodiment of a pump system in accordance with the present disclosure.

In FIG. 2*a* the hydraulic line 24 interconnects both valve housings 20*a*' and 20*b*' (cylinder chambers 23*a* and 23*b*) of the discharge valves 20*a* and 20*b* on the piston side thereof at the side of the piston elements 22*a* (22*b*). In FIG. 2*b* another embodiment of a pump system is shown. The embodiment of FIG. 2*b* is largely identical to the embodiment of the pump system disclosed in FIG. 2*a* and described above and also its operation is identical. However in FIG. 2*b* reference numeral 24' depicts a hydraulic line, similar to the hydraulic line 24 of FIG. 2*a*, which interconnects both valve housings 20*a*' and 20*b*' of the discharge valves 20*a* and 20*b* on the cylinder side thereof at the side of the piston rods 22*a*'-22*b*' opposite to the side of the piston elements 22*a* (22*b*).

By interconnecting both valve housings 20*a*' and 20*b*' via the interconnecting hydraulic line 24-24', these small volume and pressure pulsations are no longer present as the displaced volume of one discharge valve is compensated by the same volume change created by the other discharge valve.

Figure 2C:
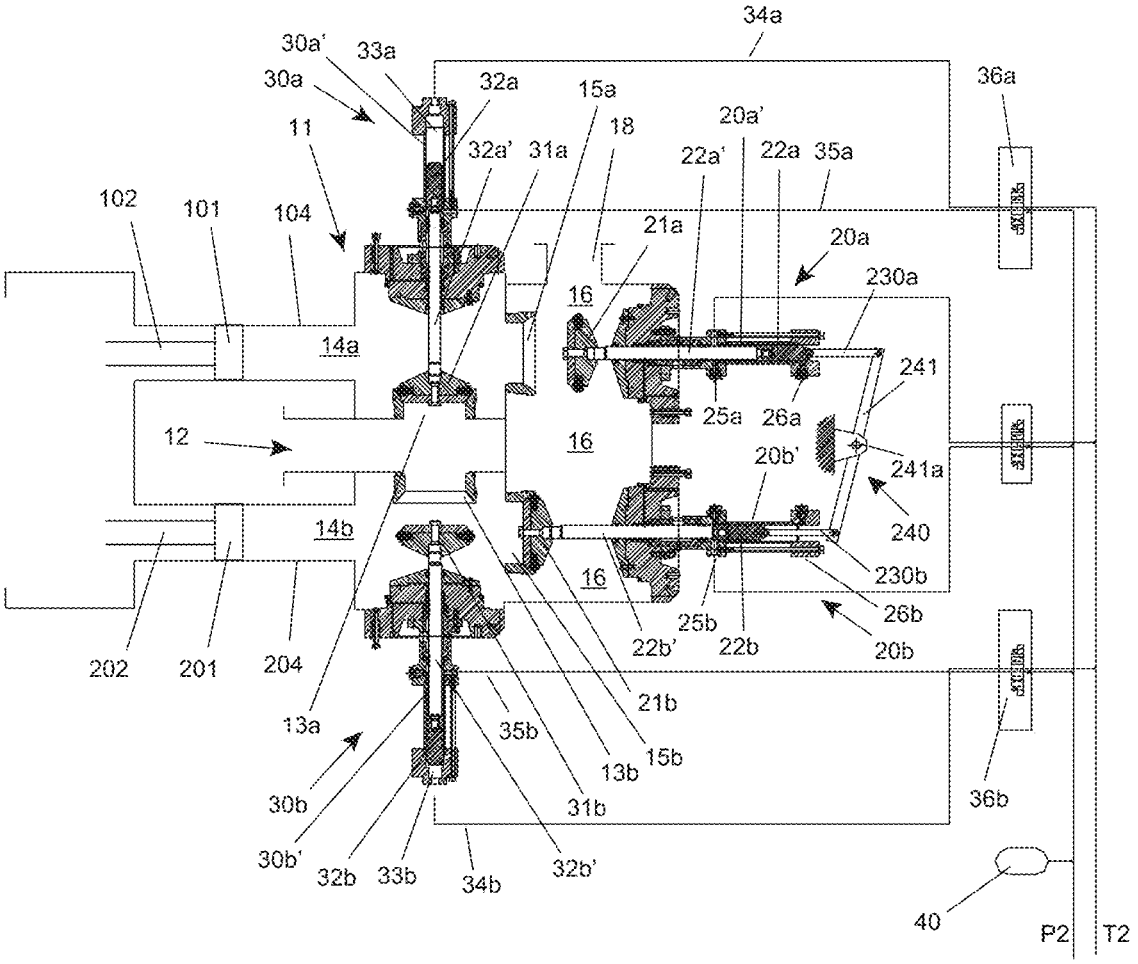
FIG. 2*c* a partial view of yet another embodiment of a pump system in accordance with the present disclosure.

In order to guarantee the simultaneous closing and opening of both discharge valves such that no volume differences between both cylinder chambers 23*a* and 23*b* occurs, in both embodiments shown in FIGS. 2*a*, 2*b* and 2*c* each discharge valve 20*a* (20*b*) is provided with sensors 25*a*-26*a* (25*b*-26*b*) which detect the extreme positions of the piston elements 22*a* (22*b*) within the cylinder chamber 23*a* (23*b*) when in fully closed or fully open position.

In particular, the sensor 25*a* (25*b*) will generate a signal when the valve body 21*a* (21*b*) is completely closing their respective discharge outlet 15*a* (15*b*) as the sensor 25*a* (25*b*) will properly detect the position of the piston element 22*a* (22*b*) in that extreme closing position. Likewise sensor 26*a* (26*b*) will detect the piston element 22*a* (22*b*) in its other extreme position, meaning that the discharge valve 20*a* (20*b*) is fully open. In particular the control mechanisms of both of the discharge valves 20*a*-20*b* are interconnected.

Sensor 25*a* (which detects the fully closed position of the discharge valve 20*a*) is interconnected with the sensor 26*b* (which detects the fully open position of the discharge valve 20*b*) and likewise sensor 25*b* (which detects the fully closed position of the discharge valve 20*b*) is interconnected with the sensor 26*a* (which detects the fully open position of the discharge valve 20*a*). By interconnecting the sensors of both discharge valves 20*a*-20*b* on opposite sides of the piston element 22*a*-22*b*, a proper control is obtained as their simultaneous actuation by their respective closing or opening valve guarantees a fully synchronization of the opening and closing of both discharge valves.

This also guarantees that no change will occur in the hydraulic medium volume in both cylinder chambers 23*a*-23*b* and the interconnecting hydraulic line 24 (24').

The opening of say the hydraulic valve 20*b* (starting from the situation in FIG. 2) will be detected by the sensor 25*b* and will simultaneously also be detected by sensor 26*a* as the discharge valve 20*a* is being moved towards its closed position. The simultaneous actuation of the sensor 26*b* and 25*a* will trigger the fully open position of the discharge valve 20*b* and the fully closed position of the discharge valve 20*a*. Any deviation of the simultaneous actuation of both sensor pairs 25*a*-26*b* and 25*b*-26*a* will be a signal that a change in the volume occupied by the hydraulic medium in the cylinder chambers 23*a* and 23*b* and the hydraulic line 24-24' has occurred.

Any shortage of hydraulic medium can be supplied via the valve 29 and interconnecting line 24 (24'). Likewise any surplus of hydraulic medium can be removed interconnecting line 24 (24') and valve 29.

In FIG. 2*c* yet another embodiment of a pump system is disclosed, wherein the control means for controlling the alternate closing and opening of both piston/cylinder discharge valves, such that during operation no volume difference occurs in the discharge of slurry medium comprise a lever assembly 240 interconnecting the piston elements 22*a*-22*b* of both piston/cylinder valves 20*a*-20*b*.

As shown said lever assembly 240 comprises a lever 241 having two ends, each end being hingely connected with either piston element 22*a* (22*b*) of one of said piston/cylinder driven valves 20*a*-20*b*. In addition and as shown in FIG. 2*c* the lever assembly 240 comprises two sub-lever elements 230*a*-230*b*, each connected to their respective piston element 22*a*-22*b* as well as with either end of the lever 241.

Preferably each connection is a hinge connection.

The lever 241 is hingely connected at its midpoint 241*a* with the solid wall.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner"

and "outer", "above", "below", "upper" and "lower" and the like are used as words of convenience to provide reference points and are not to be construed as limiting terms.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

The invention claimed is:

1. A hydraulic pump system for handling a slurry medium, the hydraulic pump system comprising:

at least two individual reciprocating positive displacement pumps, wherein each of the at least two individual pumps, consisting of a pump structure in which a displacement element connected via a piston rod is movable in a reciprocating manner accommodated in a cylinder housing, and each of the at least two individual pumps comprises a suction inlet and a discharge outlet, the at least two individual pumps being arranged in a parallel, independent manner for alternating intake of the slurry medium via the suction inlet and discharge of the slurry medium via the discharge outlet; and at least two discharge valves for independent alternating closing and opening each discharge outlet, wherein the discharge outlets communicate in a combined discharge chamber and further with a central discharge outlet, and wherein each of the at least two discharge valves include a valve body mounted to a piston, wherein the piston is movably positioned within a cylinder chamber formed in a valve housing; and a control means for controlling the alternate closing and opening of the at least two discharge valves, wherein said control means is a hydraulic line interconnecting the cylinder chambers at a same side of the piston of said at least two discharge valves, causing during operation a simultaneous switching of the at least two discharge valves from their open and closed position such that no volume fluctuation occurs in the discharge of the slurry medium.

2. The hydraulic pump system according to claim 1, wherein the same side of the piston is a side of the piston opposite the valve body.

3. An hydraulic pump system according to claim 1, wherein the same side of the piston is a side of the piston with the valve body.

4. The hydraulic pump system according to claim 1, further comprising hydraulic piston and cylinder driven suction valves for alternating closing and opening each suction inlet.

5. The hydraulic pump system according to claim 1, further comprising a pump housing having a central inlet interconnecting the suction inlets as well as the central outlet interconnecting the discharge outlets.

6. The hydraulic pump system according to claim 5, wherein said pump housing comprises two pump chambers, each pump chamber being interconnected with one of said reciprocating positive displacement pumps and each pump chamber being provided with the suction inlet and the discharge outlet.

7. The hydraulic pump system according to claim 1, wherein each of the at least two discharge valves comprises a first sensor for sensing a position of the piston in the closed position of the at least two discharge valves, as well as a second sensor for sensing a position of the piston in the open position of the at least two discharge valves.

8. The hydraulic pump system according to claim 7, further comprising hydraulic refill means for adding hydraulic medium to the at least two discharge valves based on signals generated by the first sensor and the second sensor.

* * * * *